US010753592B2

(12) United States Patent
Nölle

(10) Patent No.: US 10,753,592 B2
(45) Date of Patent: Aug. 25, 2020

(54) LUMINAIRE

(71) Applicant: Nölle Industrielle Umwelttechnik GmbH, Rheinberg (DE)

(72) Inventor: Jürgen Nölle, Rheinberg (DE)

(73) Assignee: Powermoon GmbH, Rheinberg (DE)

( * ) Notice: Subject to any disclaimer, the term of this patent is extended or adjusted under 35 U.S.C. 154(b) by 0 days.

(21) Appl. No.: 16/385,022

(22) Filed: Apr. 16, 2019

(65) Prior Publication Data

US 2019/0323698 A1 Oct. 24, 2019

(30) Foreign Application Priority Data

Apr. 19, 2018 (DE) ..... 20 2018 002 012 U

(51) Int. Cl.

| | |
|---|---|
| ***F21V 29/70*** | (2015.01) |
| ***F21S 6/00*** | (2006.01) |
| ***F21V 21/30*** | (2006.01) |
| ***F21V 23/00*** | (2015.01) |
| ***F21V 23/06*** | (2006.01) |
| ***F21Y 113/17*** | (2016.01) |
| ***F21Y 115/10*** | (2016.01) |
| ***F21W 131/10*** | (2006.01) |

(52) U.S. Cl.

CPC ..... *F21V 29/70* (2015.01); *F21S 6/005* (2013.01); *F21V 21/30* (2013.01); *F21V 23/003* (2013.01); *F21V 23/06* (2013.01); *F21W 2131/10* (2013.01); *F21Y 2113/17* (2016.08); *F21Y 2115/10* (2016.08)

(58) Field of Classification Search

CPC ... F21V 21/14–35; F21V 19/003–0055; F21V 23/003–006; F21S 6/00–008; F21K 9/20; F21K 9/238

See application file for complete search history.

(56) References Cited

U.S. PATENT DOCUMENTS

2010/0118532 A1* 5/2010 Liang ..... F21S 2/005 362/235
2013/0134446 A1* 5/2013 Wang ..... F21K 9/00 257/88

FOREIGN PATENT DOCUMENTS

| | | | | |
|---|---|---|---|---|
| CN | 201836734 U | * | 5/2011 | ..... F21S 6/003 |
| CN | 102221183 A | * | 10/2011 | |
| CN | 104075148 A | * | 10/2014 | |
| CN | 104078319 A | * | 10/2014 | |
| CN | 108916701 A | * | 11/2018 | |
| DE | 102010008788 A1 | * | 8/2011 | ..... F21S 6/002 |

* cited by examiner

*Primary Examiner* — Mariceli Santiago
(74) *Attorney, Agent, or Firm* — Michael Soderman

(57) ABSTRACT

A luminaire, in particular as a table, camping, work, party or garden luminaire, comprising at least one mounting, one supply voltage terminal, and one fastening element for at least one LED light. The LED luminaire is comprised of at least one LED panel that is movably articlulated at the fastening element. The object is to provide an LED panel that can be made available in a small-dimensional flat design and that can prevent an overheating of the individual LEDs.

17 Claims, 8 Drawing Sheets

LUMINAIRE

CROSS REFERENCE TO RELATED APPLICATIONS

This application claims the priority of DE 202018002012.5 filed on 2018 Apr. 19; this application is incorporated by reference herein in its entirety.

BACKGROUND

The invention relates to a luminaire, in particular as a table, camping, work, party or garden luminaire, comprising at least one mounting, one supply voltage terminal, and one fastening element for at least one LED light.

A variety of luminaires is offered, for example as interior lights in the form of luminaires suspended at the ceiling or the wall which usually provide a connection capability for the supply voltage and accommodate one or several lamps which are either surrounded by a lamp shade consisting of glass, ceramics or plastics, or include a frame with a fabric cover. Moreover, many recessed luminaires are used indoors which are either embedded in a wall or in a ceiling.

For outdoors, too, most diverse housing types for luminaires are offered, which may consist, for example, of metal, plastics or glass. These are essentially wall luminaires, optionally also recessed luminaires for an eave, or garden luminaires which are used flush with the floor or as floor luminaires. With the exception of floor luminaires, all of the above-mentioned luminaires are provided for permanent installation and must meet, for outdoors, the corresponding provisions of moisture protection. If the luminaires are permanently installed, these are not transportable, and if the luminaires are table luminaires or the like, they are usually very voluminous and have a disturbing effect when a table decoration is provided.

SUMMARY

The invention relates to a luminaire, in particular as a table, camping, work, party or garden luminaire, comprising at least one mounting, one supply voltage terminal, and one fastening element for at least one LED light. The LED luminaire is comprised of at least one LED panel that is movably articlulated at the fastening element. The object is to provide an LED panel that can be made available in a small-dimensional flat design and that can prevent an overheating of the individual LEDs.

DETAILED DESCRIPTION

The object underlying the present invention is to indicate a novel luminaire which is of a simple construction, has a high flexibility for its outdoor use, and offers sufficient protection from moisture by using low-voltage.

To achieve the object, a luminaire is suggested which consists of at least one LED panel which is movably articulated at a fastening element. Further advantageous embodiments of the invention can be taken from the subclaims.

By using an LED luminaire, one can apply a low voltage outdoors, and if it consists of an LED panel, it may moreover be extremely flexibly adapted to the required illumination desires. The movable articulation of an LED panel to a fastening element here permits the orientation of the LED luminaire into a desired direction and a quick reorientation if desired. The fastening element itself is connected with a mounting which fixes the LED luminaire in the desired position. The LED luminaire may thus be employed, for example, as an indirect luminaire for light emission in the garden area. It is also possible to fasten the luminaire at an elevated position and to illuminate certain areas of a terrace, a balcony, a table or a workplace. It is furthermore possible to use the LED luminaire for camping purposes or as a party and garden lamp.

The employed fastening element here permits the accommodation of an even or an uneven number of LED panels, so that a plurality of LED panels may be used and the light intensity be increased in this manner. Typically, for example one single panel, but also two, three or more panels may be used. Preferably, the at least one LED panel is fastened at the level of the mounting so that light may be emitted towards the bottom, though not exclusively.

The at least one LED panel may be provided with a supply voltage via a pin-and-socket connection, where usually a transformer or a battery with a DC voltage output of 12 Volt is sufficient.

To generate different colours, LEDs in RGB colours may be arranged on an LED panel, so that either red, green or blue colours are generated, or a colour mix with different colour variants is possible. Moreover, it is possible that one individual or several LED panels is/are dimmable or are controlled via a control, preferably a GMX control, to achieve various light effects in this manner.

It is to be considered as particularly advantageous that several panels are designed to be foldable, or that the LED panels are connected to a fastening bow via a releasable fastening clip so that the luminaire may be very easily dismounted. It is additionally possible that at least one LED panel or several ones are swivelling about a horizontal axis, wherein the LED panels may be swivelling independently.

In one development of the invention, the fastening element consists of a gusset plate which comprises a central section originating from which star-shaped lugs are integrally formed, wherein the LED panels may be placed onto the free ends of the lugs, and the LED panels, to this end, include receiving elements at their back.

A gusset plate permits the arrangement of several spaced-apart LED panels which preferably emit light in one direction. These may be gusset plates that receive one, two or several LED panels, depending on how many lugs are integrally formed to the gusset plate. The LED panels themselves have receiving elements on their backs which may consist, for example, of a bow which is connected to the back of the LED panels so that the lugs may engage the bows. Or else, a receiving pocket may be embodied into which the lugs are inserted. Thus, there is a pluggable connection which permits a change of the light conditions at any time. Moreover, by this arrangement, the complete luminaire may be dismounted in a very simple form and thereby be made transportable. Furthermore, the lugs may have sufficient flexibility so that a rotation of the individual LED panels with respect to the gusset plate is possible.

In a further development of the invention, the fastening element consists of individual lugs which are mounted to be swivelling about a centre of motion, wherein in turn the LED panels may be placed onto the free ends of the lugs and the LED panels have receiving elements on their backs to this end. The lugs used in this case are at one end fastened to each other in a centre of motion in such a manner that a rotary motion about up to 360 degrees is possible, so that the lugs may be folded open like a fan. Here, it is possible to exert a contact force onto the lugs by spring action and to only rotate the individual lugs with respect to each other by overcoming the spring force, wherein several locking steps may be provided so that the lugs may be oriented at a certain angle with respect to each other, for example 45, 90, 60 or 120 degrees, depending on how many LED panels are used. The free ends of the lugs are used in turn to put on the LED panels so that an easy assembly and disassembly are possible and in particular a quick set-up of the luminaire is ensured. The LED panels are here, as with the gusset plate, equipped with receiving elements on their backs into which the lugs may be inserted. As an alternative, it is possible that the fastening element consists of individual lugs which are each connected with an LED panel and where several lugs are rotatably mounted via a gudgeon.

In a further special development of the invention, the fastening element consists of an angular bow to which the LED panels are held by means of fastening clips. By using a bow, it is in turn possible to fasten single or multiple LED panels to the bow with the aid of fastening clips. The bow may have a rectangular shape, a triangular shape, a square shape, or a polygonal shape, wherein the bow is dimensioned large enough that at one single side edge each, one LED panel may be fastened with the aid of fastening clips. The maximum number of LED panels is determined by the number of side edges. The bow here has a central part which has an approximately star-like shape and is centrically mounted within the bow and provided for fastening the luminaire to the mounting. The mounting itself preferably consists of a stand or a bar onto which the gusset plate, the swivelling lugs, or the central part of the bow may be placed and locked. Here, it is easily possible to extend the mounting like a telescope and bending is permitted in the upper region, so that a particular orientation of the individual LED panels is allowed.

Moreover, the object underlying the present invention is to indicate an LED panel which may be made available in a small-dimensioned flat design and prevents an overheating of the individual LEDs.

To achieve the object, the LEDs are arranged in rows on a support element as a cooling body, wherein there is a distance of 4 to 15 mm between the rows and the LEDs, preferably 5 to 6 mm between the LEDs and 8 to 10 mm between the rows. By the provided distance of the individual LEDs, the support element, which is simultaneously embodied as a cooling body, is subjected to temperature only selectively. The temperature arising due to the switched-on LEDs, however, is simultaneously sufficiently dissipated as emitted heat without resulting in a negative influence of the adjacent LEDs. Depending on the distance of the individual LEDs, a flat cooling plate of metal is thus absolutely sufficient. Preferably, the supporting material is here made of a heat conducting material, for example copper or aluminium.

In a particular embodiment, the support element consists of a heat conducting material bent in a zigzag shape. A zigzag shape of the support element offers a nearly identical refrigerating capacity, but also permits to clearly increase the number of LEDs used on the support element, so that consequently, a higher light amount may be emitted.

To manufacture the LED panels, first of all, an insulating layer is applied onto the support element either in the form of a flat material or of a zigzag material, whereupon subsequently the LEDs are arranged at corresponding distances with respect to each other. The LEDs are interconnected with electrically conductive connections and with a connection element for a supply voltage so that all LEDs may be supplied with voltage. Then, the LEDs are embedded in a gel layer which simultaneously establishes a firm connection with the support element, so that sufficient protection for the LEDs from moisture and moreover an insensitiveness with respect to impacts and shocks is given. It is furthermore possible to apply a coloured gel layer to have an influence on the emitted colour. The LEDs here usually emit white light which is used for exciting the gel layer whose atoms or electrons permit a change of colour by absorption of the photons and emissions in another frequency range.

BRIEF DESCRIPTION OF THE DRAWINGS

The invention will be further illustrated again below with reference to the figures.

In the drawings.

DETAILED DESCRIPTION OF THE PREFERRED EMBODIMENTS

Figure 1:
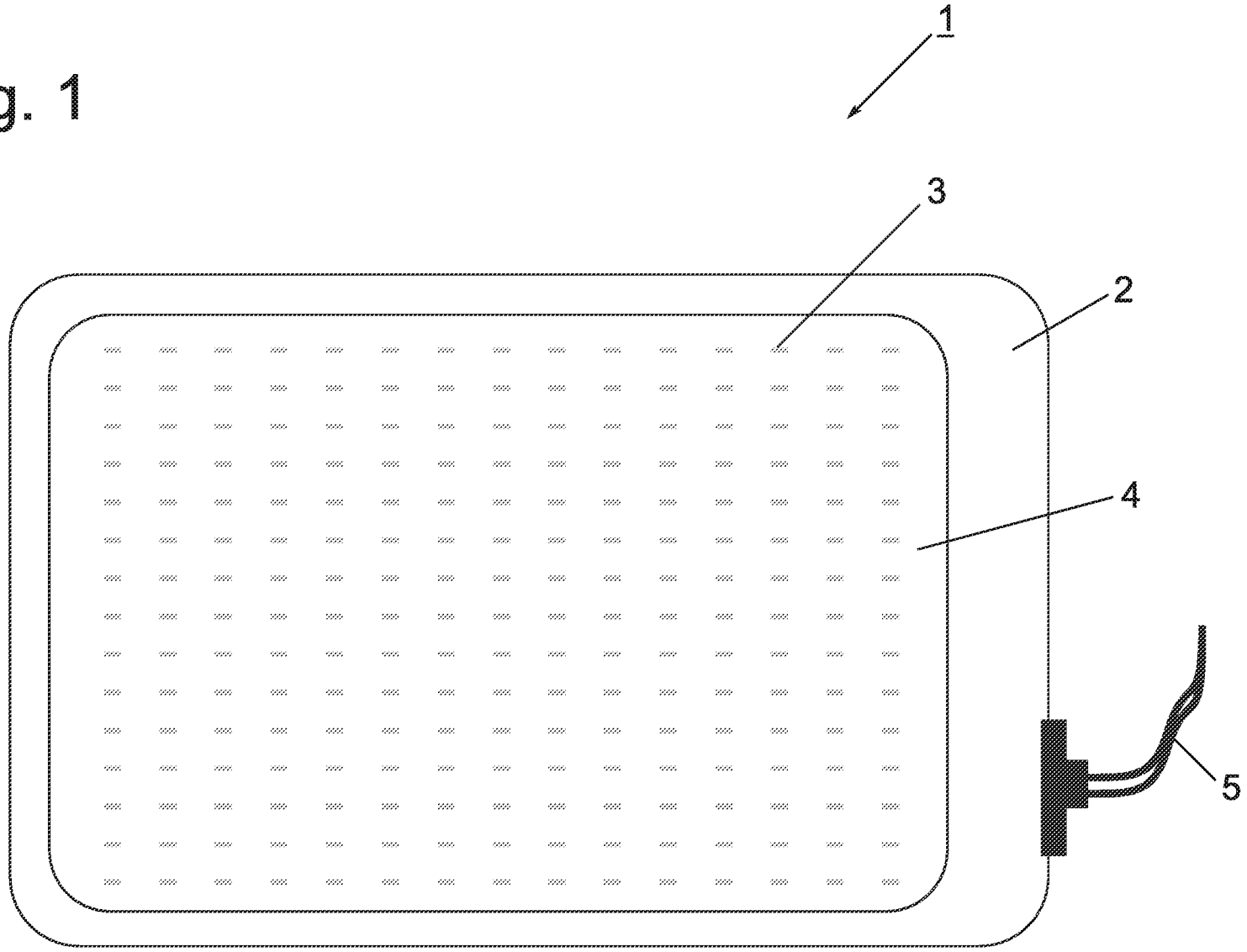
FIG. 1 shows a rectangular LED panel in a plan view.

FIG. 1 shows, in a plan view, an LED panel 1 that can be used for setting up a luminaire, in particular as a table, camping, work, party or garden luminaire. The LED panel 1 consists of a rectangular support element 2 which is preferably made of metal, in particular of aluminium or copper. After the application of a protective layer, individual LEDs 3 are arranged thereon in parallel rows, wherein the distance of each LED 3 with respect to the adjacent LEDs 3 has been selected such that the generated heat may be uniformly emitted to the support element 2 and there will be no mutual heat influence of the LEDs 3. The distance of the LEDs 3 is here optimised such that the heat may be directly emitted into the support element 2 and from there to the surrounding area. All LEDs 3 are embedded in a gel layer 4 which protects the LEDs 3 from destruction and moreover offers moisture protection. The LEDs 3 are connected to each other on the support element 2 above the insulation layer in an electrically conductive manner such that all LEDs 3 may simultaneously also be provided with voltage optionally in groups via a connecting cable 5. To this end, in the shown embodiment, there are non-visible thin electric connection wires on the insulation layer which are guided to the connecting cable 5.

By the support element 2 consisting of a heat conducting material, thus the heat of all LEDs 3 may be reliably dissipated and in particular emitted via the back face of the support element 2. The shown embodiment consists of a plane support element 2, wherein, however, it is easily possible that the support element 2 is bent in a zigzag manner and also consists of a heat conducting material. By disposing the support element 2 in a zigzag arrangement, it is possible to provide a higher number of LEDs 3 with the same outer dimensions to increase light intensity in this manner. By the zigzag folding of the support element 2, it is nevertheless sufficiently possible to emit the arising heat to the rear. The gel layer 4 may be additionally coloured to achieve a certain colour temperature, so that the emitted light of the LEDs 3, that is actually white, may be changed.

Figure 2:
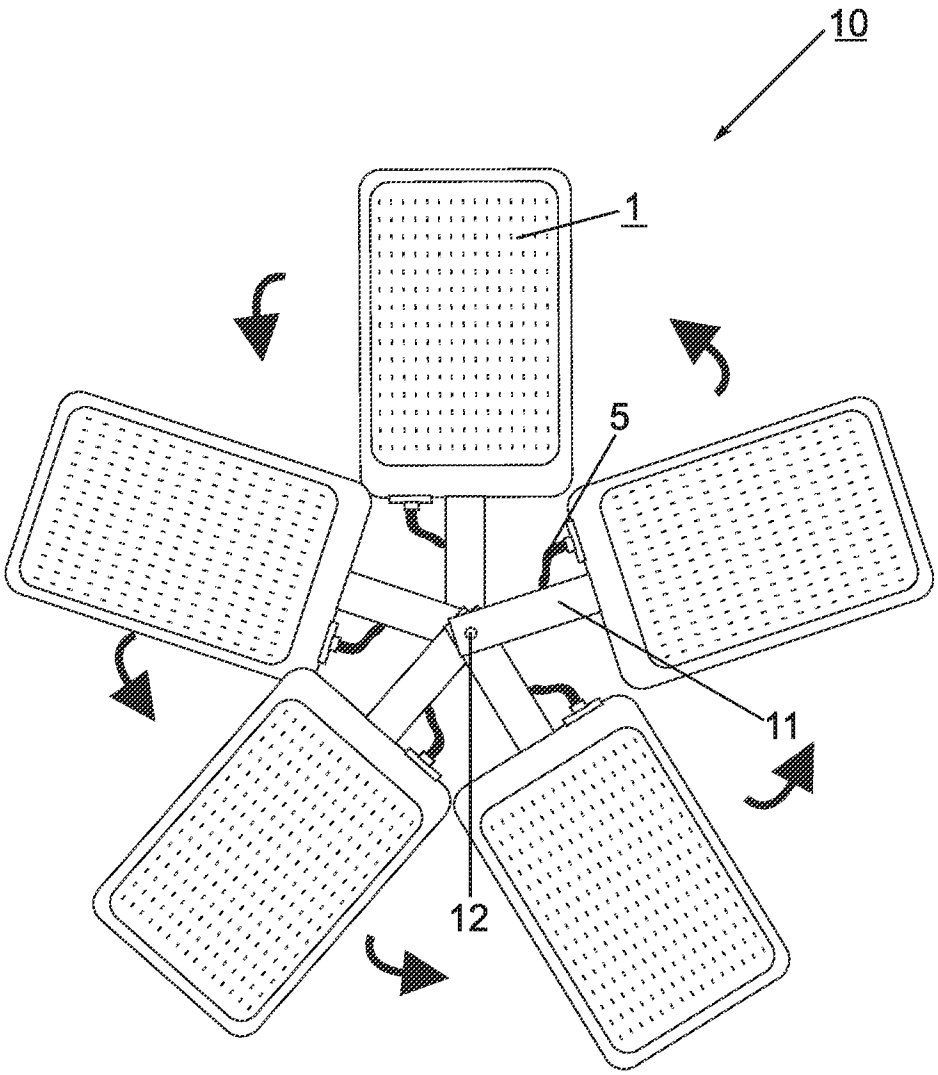
FIG. 2 shows, in a plan view, the assembly of several LED panels according to FIG. 1 into a luminaire in a fanned out arrangement and in an arrangement where they are partially shifted one over the other.
Figure 2:
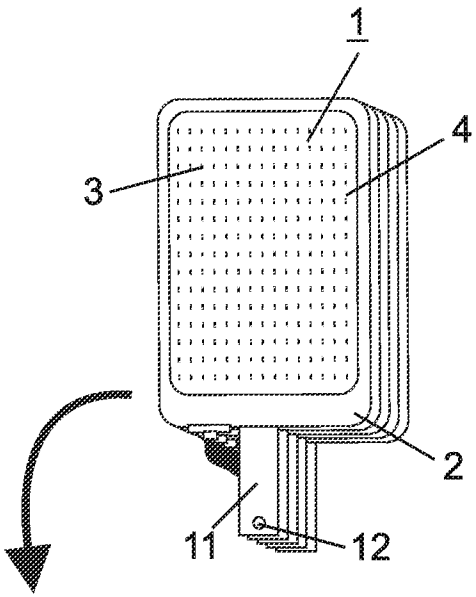

FIG. 2 shows, in a plan view, several LED panels 1, as they are known from FIG. 1, in a form where they are lying one upon the other, which has been fanned out in the second partial figure. All individual LED panels 1 may also be used as luminaire 10 after having been fanned out. An LED panel 1 here consists of a support element 2 with individual LEDs 3 and a gel layer 4. The LED panels 1 here each have a lug 11, the lugs being interconnected by means of a gudgeon 12 so as to be movable in a pivoting manner. In the left Figure, altogether five LED panels 1 are arranged lying one upon the other, while in the right Figure, these are fanned out and thus result in a nearly star-shaped arrangement. Via corresponding fastening means, such a fanned-out luminaire 10 may be used, for example, as a garden luminaire etc. The gudgeon 12 is here simultaneously used as a fastener to a stand, a wall or comparable fastening options. Each individual LED panel 1 is connected with a non-depicted supply voltage via a connecting cable 5, wherein the individual connecting cables 5 may have one common connector.

Figure 3:
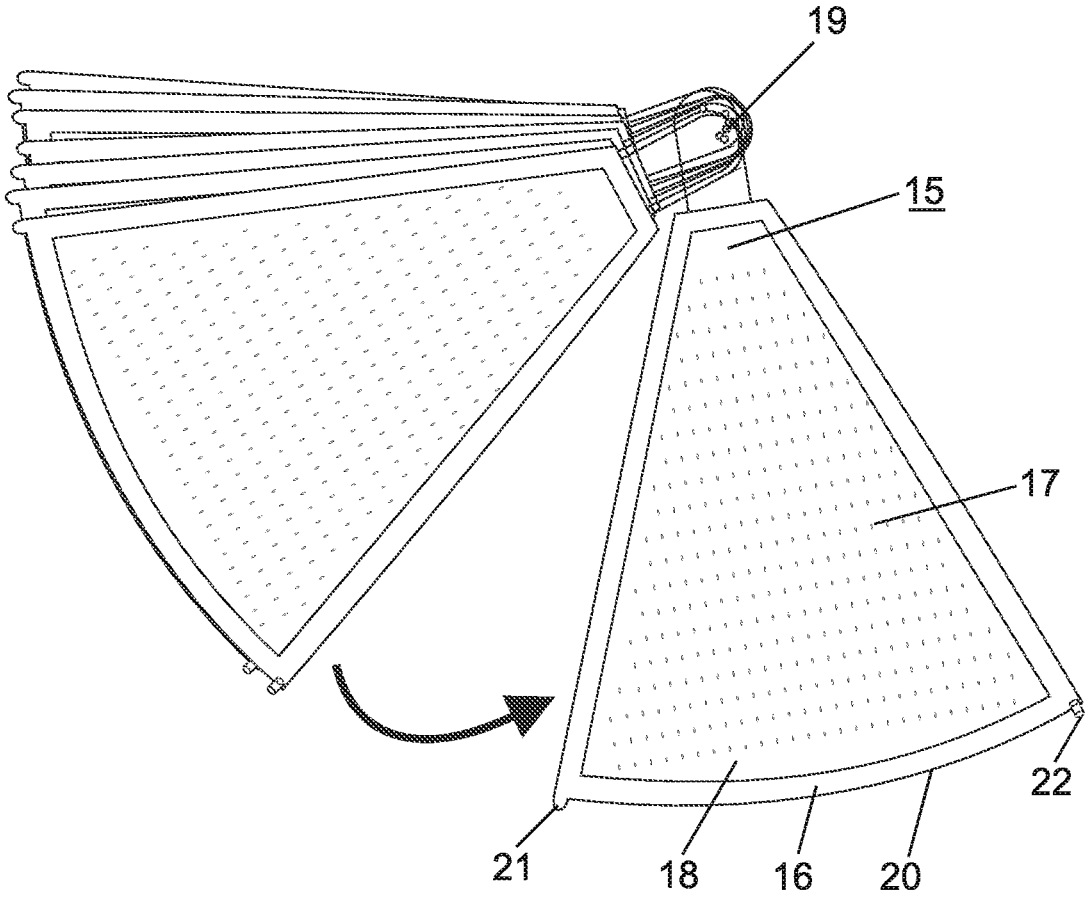
FIG. 3 shows, in a plan view, an alternative embodiment of the LED panels in an arrangement of several LED panels which are partially shifted one over the other.

FIG. 3 shows, in a plan view, an alternative embodiment of an LED panel 15 that has, in contrast to FIG. 1, an approximately triangular shape, wherein the edge facing outwards has a bent design. Just as with the rectangular LED panels, the LED panel 15 consists of a support element 16 and individual LEDs 17 as well as a gel mass 18 in which the LEDs 17 are embedded. Via a screwed joint 19, the individual LED panels 15 are connected to each other so as to be movable in a pivoting manner, wherein the screwed joint 19 may not only be used for connecting the individual LED panels 15, but also for fastening them to a stand or the like. In this case, too, the individual LED panels 15 may be rotated like a fan. In a state where they are not in use, the LED panels 15 are lying one upon the other resulting in a small design, while a large illumination area is achieved when the individual LED panels 15 are fanned out. To ensure a uniform fanning out of the individual LED panels 15, these have a catch 21 and a pin 22 at their outer peripheries 25. The catch 21 is here angled downwards into the plane of the LED panel 15 located beneath, wherein the individual LED panels 15 are arranged offset with respect to each other downwards, and the catch 21 takes along the respective LED panel 15 located underneath via the pin 25, and thus a round luminaire is formed as it is depicted in FIG. 4.

Figure 4:
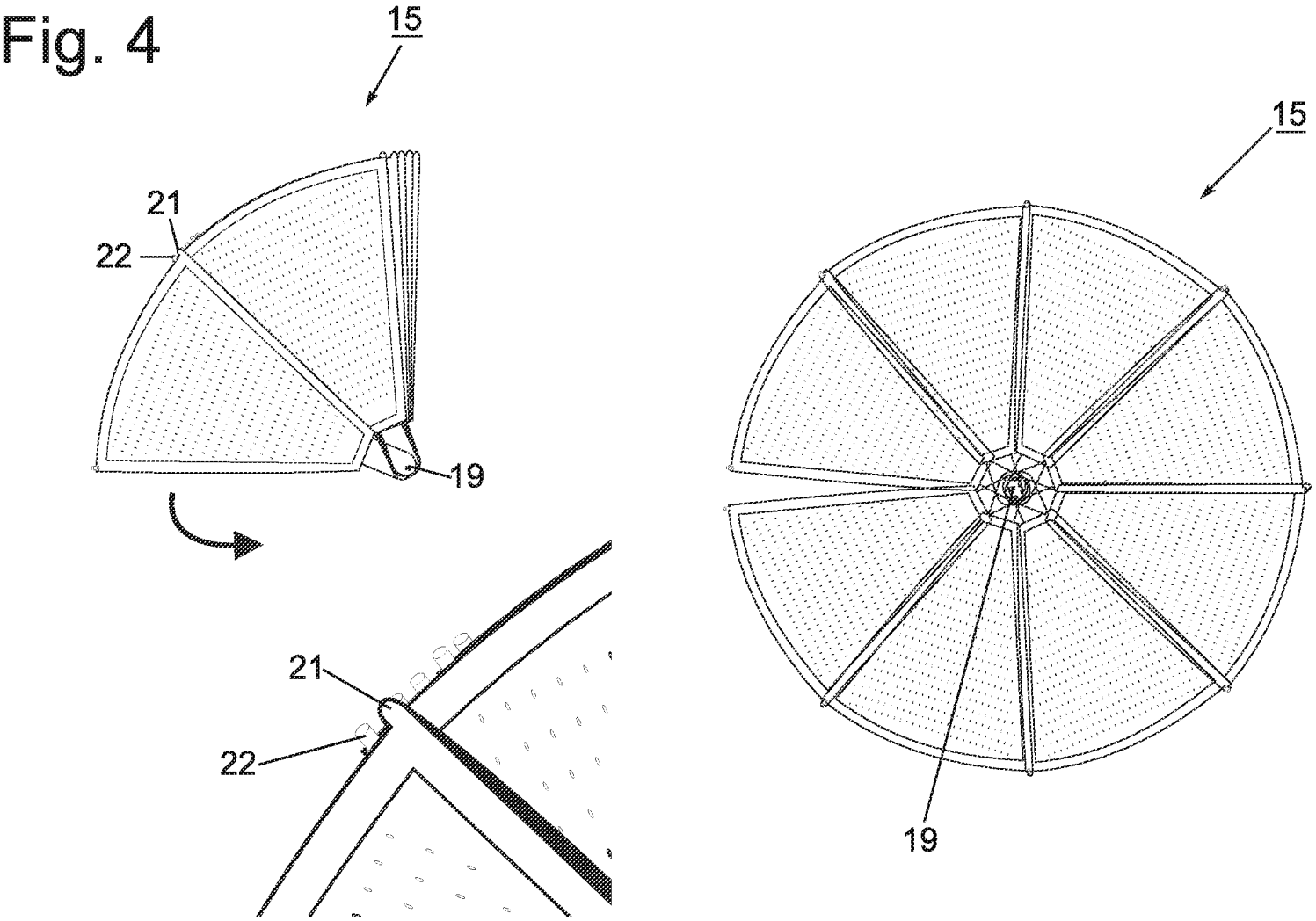
FIG. 4 shows, in a plan view, an alternative embodiment of a luminaire with a fan-like arrangement as can already be seen in FIG. 3, and, in a detailed drawing, a catch means for the individual LED panels.

FIG. 4 shows, in two plan views and one enlarged view, the LED panels 15, namely several LED panels 15 disposed one upon the other where only one LED panel is fanned out in a left figure, the catch 21 taking along the pin 22 when the LED panel 15 is further swiveled and thereby circularly fanning out the complete arrangement consisting of several LED panels 15. In the left representation, the arrangement of the LED panels 15 can be seen after they have been fanned out, wherein one catch 21 each takes along the pin 22 of the LED panel 15 located underneath, so that a fanning out of all LED panels 15 is ensured. In a state of the LED panels 15 where these are shifted into each other, one also has a handy luminaire easy to transport which may be fanned out and also be shifted together by easy handling.

From the enlarged view, the region of the pins 22 and the catches 21 is visible from the partially fanned out representation of the LED panels 15, and this clearly shows again how a catch 21 can grip the respective pin 22 located underneath to cause rotation. Each individual LED panel 15 has, at an outer periphery 25, a catch 21 and, distributed at the periphery, a pin 22 so that the respective upper LED panel 15 takes along the LED panel 15 underneath until the full circle is reached.

Figure 5:
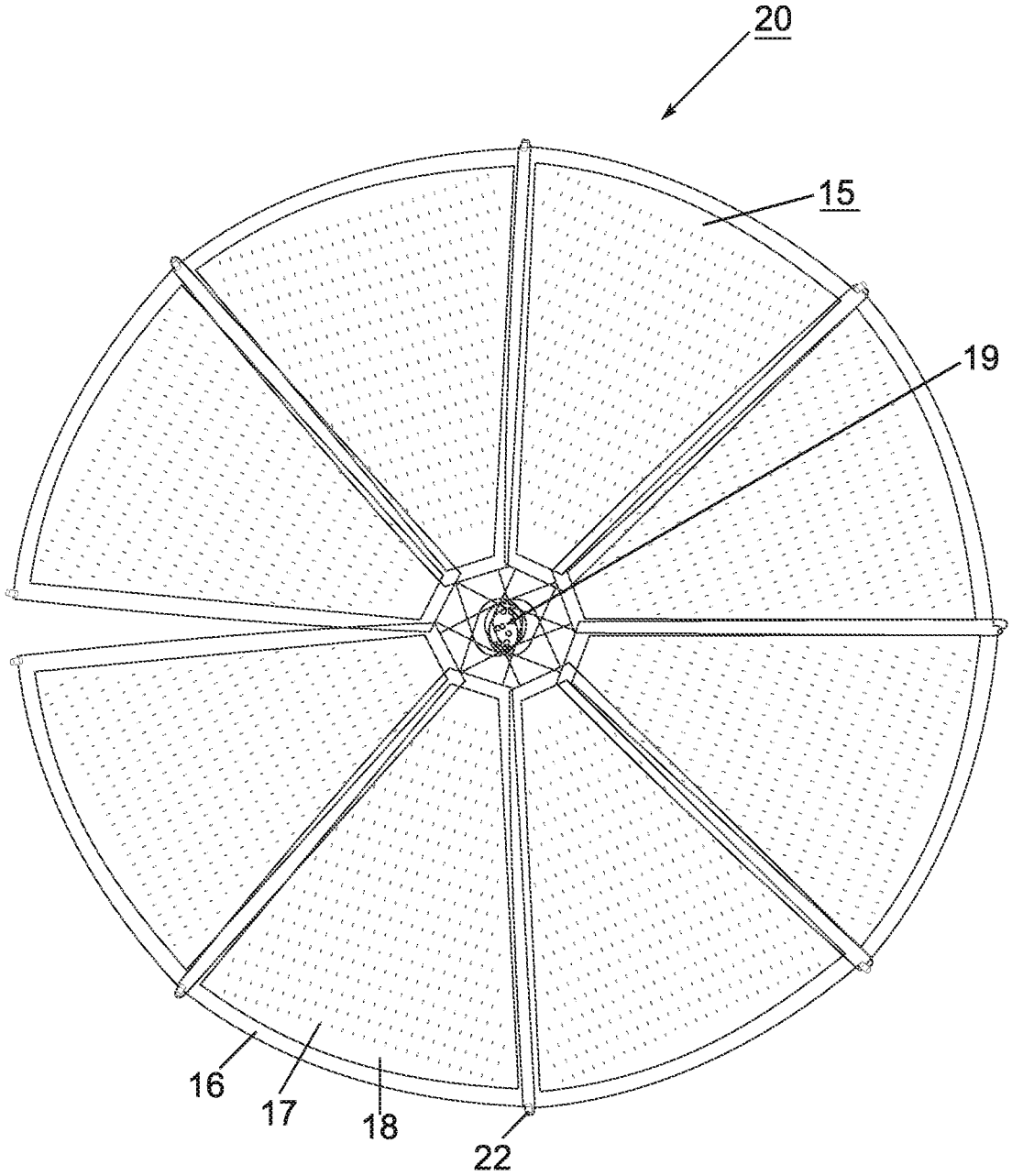
FIG. 5 shows the fanned-out LED panels according to FIG. 2 in an enlarged view.

FIG. 5 shows again, in a plan view and an enlarged representation, the representation of FIG. 4 in the form of a luminaire 20 consisting of the individual LED panels 15.

Figure 6:
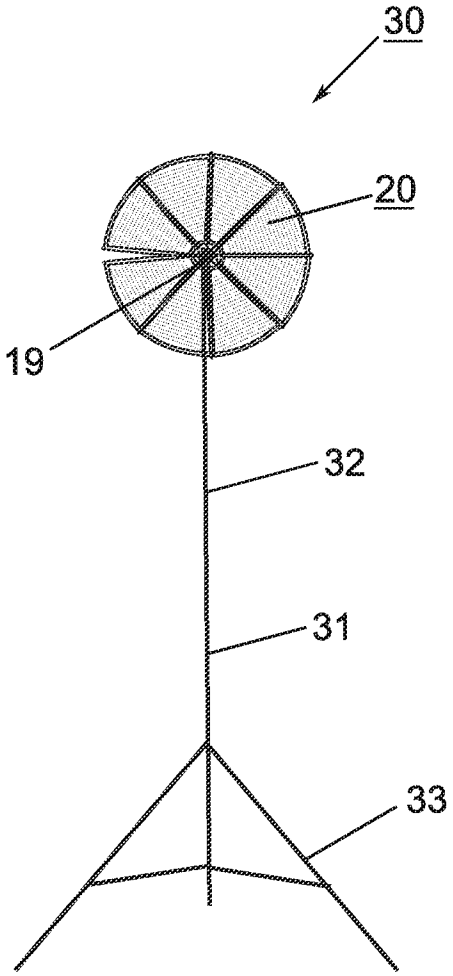
FIG. 6 shows the luminaire according to FIG. 5 with a stand.
Figure 7:
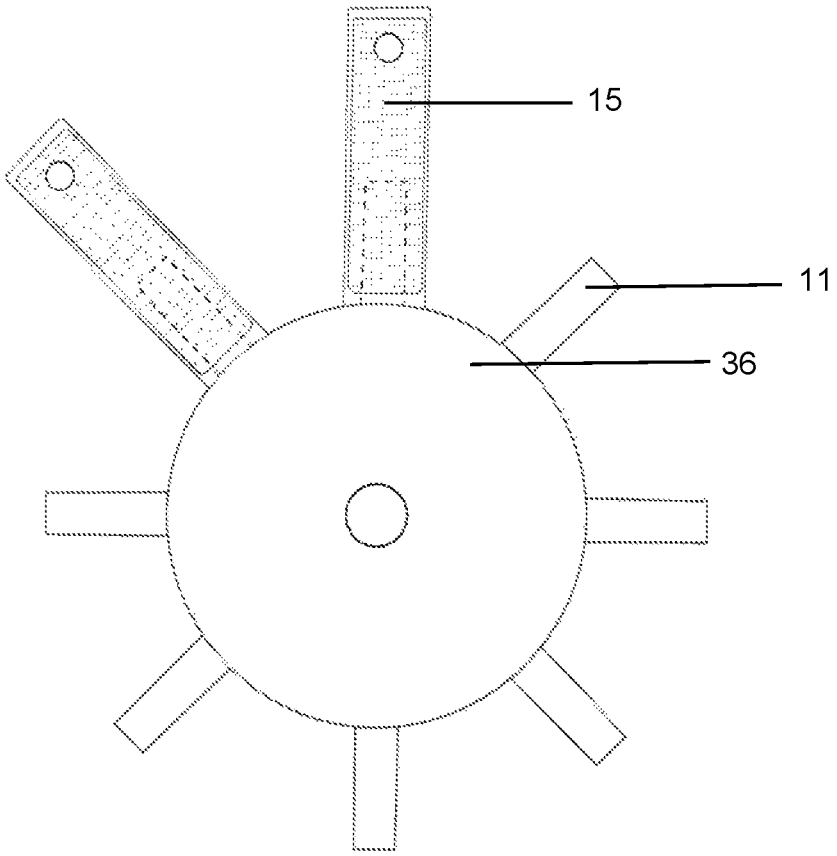
FIG. 7 shows a round gusset plate with one-piece lugs in a star shape onto which LED panels are attached.
Figure 8:
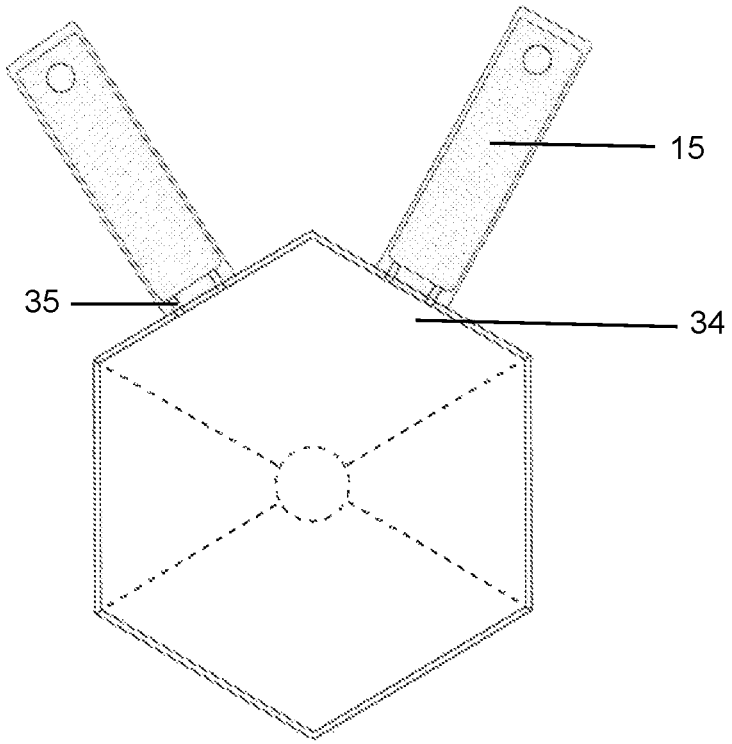
FIG. 8 shows LED panels attached to an angular bow with clips.

FIG. 6 shows, by way of example, a luminaire 30 consisting of a fanned out LED luminaire 20 with a stand 31 in a side view. The stand 31 is connected by the vertical strut 32 directly with the screwed joint 19 of the LED panels 15 and furthermore has a tripod 33 for putting it up on a plane floorspace. The luminaire 30 with the stand 31 is to be considered only as an example because the fanned out LED panels 15 may be easily also employed in a suspended version or a wall version.

LIST OF REFERENCE NUMERALS

1 LED panel
2 support element
3 LED
4 gel layer
5 connecting cable
6 support element
10 luminaire
11 lug
12 gudgeon
15 LED panel
17 LED
18 gel mass
19 screwed joint
20 luminaire
21 catch
22 pin
25 periphery
30 luminaire
31 stand
32 strut
33 tripod
34 angular bow
35 fastening clips
36 gusset plate

The invention claimed is:

1. A luminaire (10, 20, 30) comprising at least one mounting, one supply voltage terminal, and one fastening element for at least one LED light,
wherein
the LED luminaire is made up of at least two LED panels (1, 15) which are movably articulated at the fastening element, and wherein said at least two LED panels each contains a catch (21) at the outer periphery of one side and a pin (22) at the outer periphery of the other side, such that said at least two LED panels are completely fanned out when opened.

2. The luminaire (10, 20, 30) according to claim 1,
wherein
an even or uneven number of said at least two LED panels (1, 15) are articulated at one or several fastening elements connected to each other.

3. The luminaire (10, 20, 30) according to claim 1,
wherein the at least two LED panels (1, 15) are fastened at the level of the mounting.

4. The luminaire (10, 20, 30) according to claim 1, wherein the at least two LED panels (1, 15) can be provided with a supply voltage via a pin-and-socket connector.

5. The luminaire (10, 20, 30) according to claim 1, wherein the at least two LED panels (1, 15) comprise LEDs of different colours.

6. The luminaire (10, 20, 30) according to claim 1, wherein the at least two LED panels (1, 15) are dimmable.

7. The luminaire (10, 20, 30) according to claim 1, wherein the at least two LED panels (1, 15) may be controlled via a control.

8. The luminaire (10, 20, 30) according to claim 1, wherein the at least two LED panels (1, 15) are configured to be foldable, or that the LED panels are connected to the fastening element via a releasable fastening clip.

9. The luminaire (10, 20, 30) according to claim 1, wherein the at least two LED panels (1, 15) swivel about an axis.

10. The luminaire (10, 20, 30) according to claim 9, wherein the at least two LED panels (1, 15) swivel independently from each other.

11. The luminaire (10, 20, 30) according to claim 1, wherein the fastening element consists of a gusset plate which comprises a central section originating from which star-shaped lugs are integrally formed, wherein the at least two LED panels (1, 15) may be placed onto the free ends of the lugs, and the at least two LED panels (1, 15) include, to this end, receiving elements at their back.

12. The luminaire (10, 20, 30) according to claim 1, wherein the fastening element is comprised of individual lugs which are mounted to swivel about a centre of motion, wherein the at least two LED panels (1, 15) may be placed onto the free ends of the lugs and the at least two LED panels (1, 15) include receiving elements at their back to this end.

13. The luminaire (10, 20, 30) according to claim 1, wherein the fastening element consists of lugs (11) which are each connected with one of the at least two LED panels (1, 15), and that several lugs (11) are rotatably mounted via a gudgeon (12).

14. The luminaire (10, 20, 30) according to claim 1, wherein the fastening element consists of an angular bow to which the at least two LED panels (1, 15) are held by means of fastening clips.

15. The luminaire (10, 20, 30) according to claim 14, wherein the bow has a central part which is provided for fastening the luminaire (10, 20) to the mounting.

16. The luminaire (10, 20, 30) according to claim 11, wherein the mounting consists of a stand (22) or a bar, and that each of the at least two LED panels is connected to the mounting via the gusset plate, the swivelling lugs (11) or the central part of the bow.

17. The luminaire (10, 20, 30) according to claim 1, wherein the at least two LED panels (1, 15) are comprised of a cooling body with LEDs (3, 17) which are arranged on an insulation layer and are connected to each other via electrically conductive connections and to a connector or a bushing of a supply voltage terminal.

* * * * *